US010561569B2

(12) United States Patent
Ma

(10) Patent No.: US 10,561,569 B2
(45) Date of Patent: Feb. 18, 2020

(54) EYE MASSAGER

(71) Applicant: Shenzhen Breo Technology Co., Ltd., Shenzhen, Guangdong (CN)

(72) Inventor: Xuejun Ma, Guangdong (CN)

(73) Assignee: Shenzhen Breo Technology Co., Ltd., Shenzhen, Guangdong (CN)

( * ) Notice: Subject to any disclaimer, the term of this patent is extended or adjusted under 35 U.S.C. 154(b) by 431 days.

(21) Appl. No.: 15/519,635

(22) PCT Filed: Oct. 16, 2014

(86) PCT No.: PCT/CN2014/088705
§ 371 (c)(1),
(2) Date: Apr. 17, 2017

(87) PCT Pub. No.: WO2016/058154
PCT Pub. Date: Apr. 21, 2016

(65) Prior Publication Data

US 2017/0252258 A1 Sep. 7, 2017

(51) Int. Cl.

| | |
|---|---|
| ***A61H 5/00*** | (2006.01) |
| ***A61H 39/04*** | (2006.01) |
| ***A61H 7/00*** | (2006.01) |

(52) U.S. Cl.
CPC ..... *A61H 5/00* (2013.01); *A61H 7/004* (2013.01); *A61H 39/04* (2013.01);
(Continued)

(58) Field of Classification Search
CPC .... A61H 2205/02; A61H 35/02; A61H 39/04; A61H 2007/009; A61H 2201/165;
(Continued)

(56) References Cited

U.S. PATENT DOCUMENTS 4,841,954 A * 6/1989 Kalsi ..... A61H 23/0263 601/71
2006/0069331 A1* 3/2006 Huang ..... A61H 7/004 601/90

(Continued)

FOREIGN PATENT DOCUMENTS

| | | | |
|---|---|---|---|
| CN | 2374161 | 4/2000 | |
| CN | 1654036 | 8/2005 | |
| CN | 1654036 A * | 8/2005 | ..... A61H 5/00 |
| CN | 103860364 | 6/2014 | |
| CN | 104306142 | 1/2015 | |
| CN | 204147245 | 2/2015 | |
| WO | 2005007059 | 1/2005 | |

OTHER PUBLICATIONS

International Search Report of PCT/CN2014/088705 dated Jun. 26, 2015, 4 pages (English and Chinese).

*Primary Examiner* — Bradley H Philips
*Assistant Examiner* — Vincent D Hoang
(74) *Attorney, Agent, or Firm* — Rankin, Hill & Clark LLP

(57) ABSTRACT

An eye massager includes an eyeshade and a head band connected with the eyeshade. The eyeshade is provided with two massage boards, and the two massage boards are arranged symmetrically and move synchronously. The eyeshade includes an eyeshade casing, the two massage boards are located on an outer wall of an inner side of the eyeshade casing, and the eyeshade casing is provided therein with a driving assembly configured to drive the two massage boards. The driving assembly includes a motor, a gear assembly driven by the motor, a transmission shaft driven via the gear assembly, and two eccenter assemblies arranged at two ends of the transmission shaft respectively. The two massage boards are respectively fixed on the two eccenter assemblies, and are enabled to swing when being driven by the eccenter assemblies.

10 Claims, 2 Drawing Sheets

(52) U.S. Cl.
CPC ..... *A61H 2201/1215* (2013.01); *A61H 2201/1481* (2013.01); *A61H 2201/1604* (2013.01); *A61H 2201/1676* (2013.01); *A61H 2205/02* (2013.01); *A61H 2205/024* (2013.01)

(58) Field of Classification Search
CPC .... A61H 2201/1647; A61H 2201/1645; A61H 2201/1695; A61H 2201/1215; A61H 2201/1481; A61H 2201/1604; A61H 2201/1676; A61H 2201/1678; A61H 5/00; A61H 5/005; A61H 7/001; A61H 7/002; A61H 7/003; A61H 7/004; A61H 7/005; A61H 7/006; A61H 7/008
USPC ..... 74/86
See application file for complete search history.

(56) References Cited

U.S. PATENT DOCUMENTS

| | | | | |
|---|---|---|---|---|
| 2006/0074359 | A1* | 4/2006 | Huang | A61H 7/00 601/100 |
| 2006/0200052 | A1* | 9/2006 | Lin | A61H 5/00 601/70 |
| 2006/0206041 | A1* | 9/2006 | Liu | A61H 5/00 601/13 |
| 2011/0251532 | A1* | 10/2011 | Yang | A61H 23/0263 601/18 |
| 2016/0051439 | A1* | 2/2016 | Brown | A61H 21/00 601/46 |

* cited by examiner

EYE MASSAGER

FIELD OF THE INVENTION

The present invention relates to the technical field of massagers, and more particularly to an eye massager.

BACKGROUND

Existing eye massagers generally adopt two massage methods, one of the two methods is to massage by aerating and deflating an airbag, and the other one is to massage by means of vibrations. Wherein, in the first massage method, since the airbag has a big volume, it is unable to massage acupoints around eyes targetedly; in the second massage method, the vibrations can cause a large massage strength, however, skin around eyes is fragile and sensitive, and such a massage in a large strength may cause discomfort of the skin and make a person feel dizzy.

BRIEF DESCRIPTION

The purpose of the present invention is to provide an eye massager, which is configured to solve the problem in the prior art that eye massagers provide low massage comfort.

In order to solve the aforementioned technical problem, the present invention provides the following technical solution: an eye massager, which comprises an eyeshade and a head band connected with the eyeshade; wherein, the eyeshade is provided with two massage boards, and the two massage boards are arranged symmetrically and move synchronously; the eyeshade includes an eyeshade casing, the two massage boards are located on an outer wall at an inner side of the eyeshade casing, and the eyeshade casing is provided therein with a driving assembly configured to drive the two massage boards; the driving assembly includes a motor, a gear assembly driven by the motor, a transmission shaft driven via the gear assembly, and two eccenter assemblies arranged at two ends of the transmission shaft respectively; the two massage boards are respectively fixed on the two eccenter assemblies, and are enabled to swing when being driven by the eccenter assemblies.

In particular, the gear assembly includes a first gear and a second gear; the first gear is fixed on an output shaft of the motor, the transmission shaft is arranged to be parallel to the motor, the second gear is fixed on an end of the transmission shaft, and the first gear and the second gear are located at the same side and mesh with each other.

In particular, the eye massager further comprises a first bearing and a second bearing; the first bearing is fixed on one end of the transmission shaft and located at an inner side of the eccenter assemblies, and the second bearing is fixed on the other end of the transmission shaft and located at an inner side of the second gear.

In particular, each of the eccenter assemblies includes an eccenter and a bearing assembly arranged at the eccenter, an inner side of each of the two massage boards is connected with a tray, and the tray is rotatably connected with the bearing assembly.

In particular, the bearing assembly includes a third bearing, a fixing block, and a bearing casing and a lid which cooperate with each other; the eccenter is provided with an eccentric shaft, the third bearing is sheathed on the eccentric shaft, the fixing block is fixed at an outer side of the third bearing and is static relative to the eccenter, the bearing casing is axially sheathed on the third bearing, and the lid covers the bearing casing along an axial outer side.

In particular, the eccentric shaft includes a first shaft part and a second shaft part, a diameter of the first shaft part is larger than a diameter of the second shaft part, an end surface of the first shaft part facing the second shaft part is provided with a first fixing hole, the third bearing is sheathed on the first shaft part, and the fixing block is sheathed on the second shaft part and fixed in the first fixing hole by a first fastening member.

In particular, the bearing casing is provided with at least one locating hole, a side surface of the lid facing the bearing casing is provided with at least one locating pole that is capable of extending into the locating hole, and the bearing casing and the lid are connected together by a second fastening member.

In particular, a side surface of each tray that is away from the massage board is provided with a connecting shaft, a top of the bearing casing is provided with two connecting blocks that are opposite to and spaced from each other, and the connecting shaft is rotatably connected between the two connecting blocks.

In particular, a side surface of each tray that is adjacent to the massage board is provided with a connecting pole; the massage board includes a main body that has a sheet-like shape and is bent, and further includes a plurality of massage contact heads arranged at the main body; the main body is provided with a third connecting hole, and the connecting pole runs through the third connecting hole and is fixed.

In particular, the plurality of massage contact heads are distributed along an edge of the main body and correspond to acupoints around eyes of persons.

In the present invention, when the eye massager works, the output shaft of the motor rotates, and the rotation is transmitted to the eccenter assemblies via the gear assembly; under the action of the eccentric rotations of the eccenter assemblies, the two massage boards undulate and swing to massage eyes of a user. In this way, the eccentric rotations are transformed into swing, and the swing has a modest amplitude and a modest strength. Thus, the user can obtain comfort massage experience.

REFERENCE SIGN LIST

100-eyeshade; 110-eyeshade casing; 120-massage board; 121-main body; 122-massage contact head; 123-third connecting hole; 200-head band; 300-driving assembly; 310-motor; 311-output shaft; 312-engagement groove; 320-gear assembly; 321-first gear; 322-second gear; 330-transmission shaft; 340-eccenter assembly; 341-eccenter; 3411-eccentric shaft; 3411*a*-first shaft part; 3411*b*-second shaft part; 3412-first fixing hole; 342-bearing assembly; 3421-third bearing; 3422-fixing block; 3423-bearing casing; 3424-lid; 3425-locating hole; 3426-locating pole; 3427-connecting block; 3428-second connecting hole; 400-C-shaped fastener; 500-first bearing; 600-second bearing; 700-tray; 710-connecting shaft; 711-first connecting hole; 720-connecting pole; 721-thread hole.

DETAILED DESCRIPTION

In order to make the objectives, technical solutions, and advantages of the present invention be clearer, the present invention will be further described hereafter with reference to the accompany drawings and embodiments. It should be understood that the embodiments described herein are only intended to illustrate but not to limit the present invention.

It needs to be explained that if a component is described as "fixed at" or "arranged at" another component, it can be arranged at the another component directly or via a simultaneous intermediate component. If a component is described as "connected with" another component, it can be connected with the another component directly or via a simultaneous intermediate component.

It needs to be further explained that the position terms used in the present embodiment, such as "left", "right", "top", "bottom", and the like, are only mutually relative concepts or take a normal using state of the product as reference, and should not be regarded as having limitations.

Figure 1:
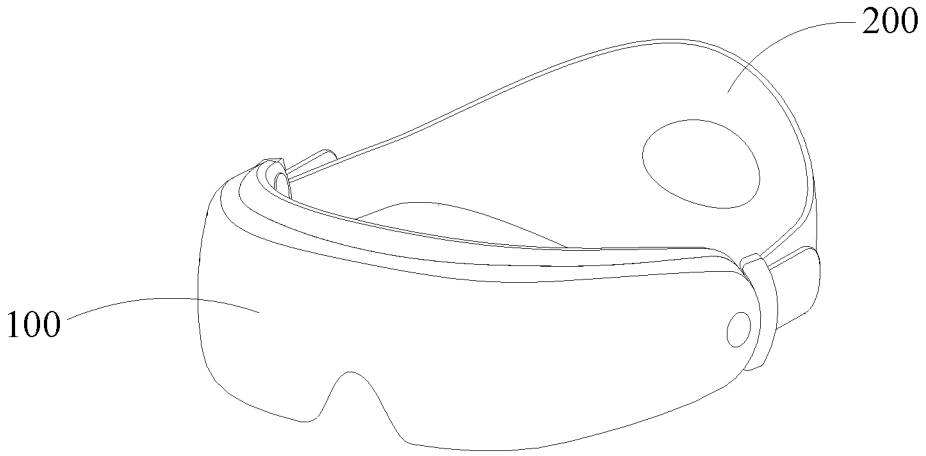
FIG. 1 is a structural schematic view of an eye massager according to an embodiment of the present invention.
Figure 2:
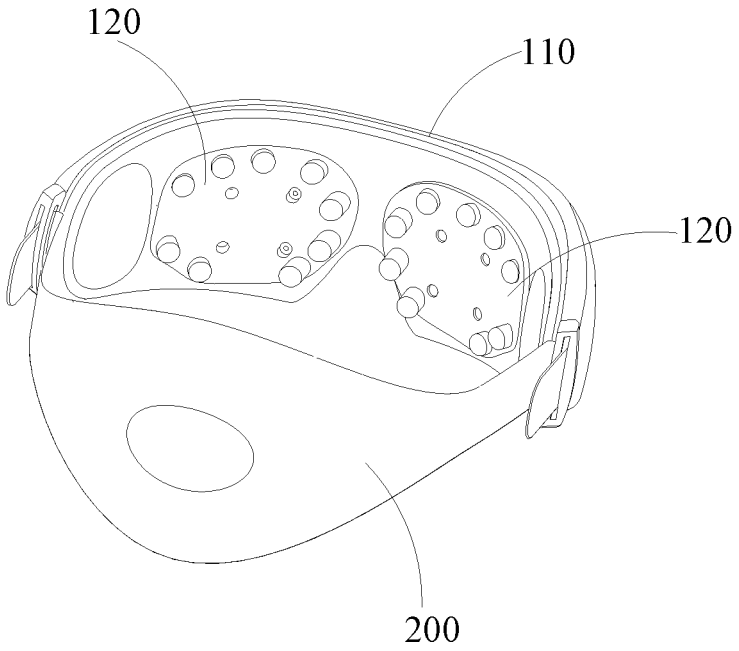
FIG. 2 is another structural schematic view, which is viewed from another angle, of the eye massager according to the embodiment of the present invention.
Figure 3:
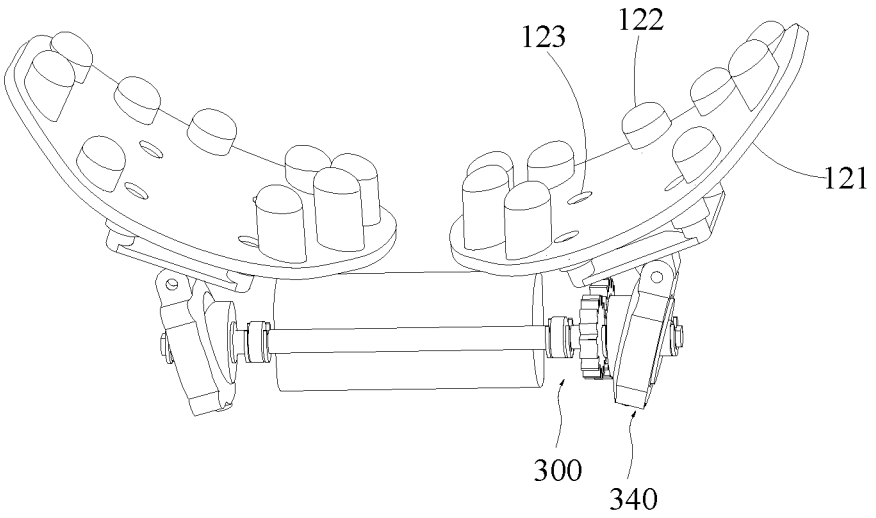
FIG. 3 is a further structural schematic view of the eye massager according to the embodiment of the present invention, wherein the eyeshade casing is removed.

Referring to FIGS. 1 to 3, an embodiment of the present invention provides an eye massager, which comprises an eyeshade 100 and a head band 200 connected with the eyeshade 100. The eyeshade 100 includes an eyeshade casing 110 and two massage boards 120. The two massage boards 120 are arranged symmetrically and move synchronously. The two massage boards 120 are arranged on an outer wall of an inner side of the eyeshade casing 110 relative to the head band 200. The eyeshade casing 110 is provided therein with a driving assembly 300 configured to drive the two massage boards 120, and the driving assembly 300 includes a motor 310, a gear assembly 320 driven by the motor 310, a transmission shaft 330 driven via the gear assembly 320, and two eccenter assemblies 340 arranged at two ends of the transmission shaft 330 respectively; the two massage boards 120 are respectively fixed on the two eccenter assemblies 340, and are enabled to swing when being driven by the eccenter assemblies 340. In this embodiment, when the eye massager works, an output shaft 311 of the motor 310 rotates, and the rotation is transmitted to the eccenter assemblies 340 via the gear assembly 320; under the action of the eccentric rotations of the eccenter assemblies 340, the two massage boards 120 undulate and swing to massage eyes of a user. In this way, the eccentric rotations are transformed into swing, and the swing has a modest amplitude and a modest strength. Thus, the user can obtain comfort massage experience.

Figure 4:
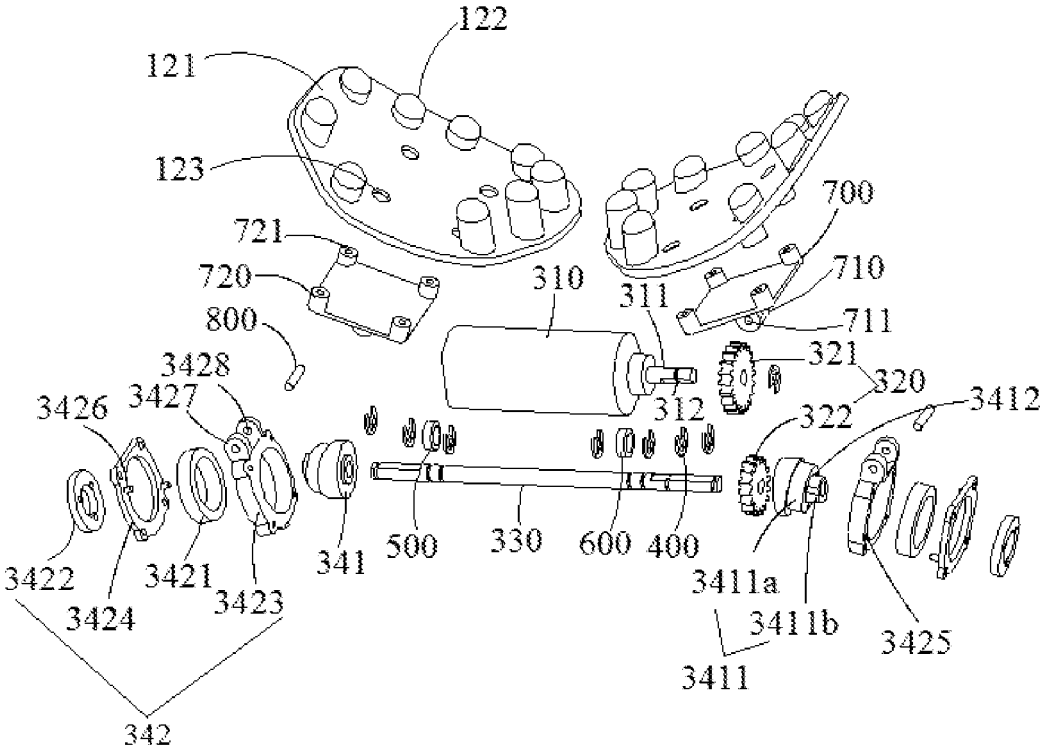
FIG. 4 is a disassembled schematic view of the eye massager according to the embodiment of the present invention.

Referring to FIG. 4, the gear assembly 320 includes a first gear 321 and a second gear 322, the first gear 321 is sheathed on the output shaft 311 of the motor 310, an end of the output shaft 311 of the motor 310 is provided with an engagement groove 312, and the first gear 321 is fixed by a C-shaped fastener 400 arranged in the engagement groove 312. The transmission shaft 330 is arranged to be parallel to the motor 310 and next to the motor 310, the second gear 322 is fixed on an end of the transmission shaft 330, and the first gear 321 and the second gear 322 are located at the same side and mesh with each other. Likewise, The second gear 322 is fixed relative to the transmission shaft 330 by a C-shaped fastener 400. In this embodiment, the rotation power is transmitted by the gear assembly 320, not only because the gear transmission is stable and reliable, but also the gear transmission is simple in structure, occupies small space, and is convenient for the layout of the inner structure.

Preferably, in this embodiment, the eye massage further comprises a first bearing 500 and a second bearing 600. Since the two massage boards 120 are respectively arranged at two ends of the transmission shaft 330 and swing in response to the rotation of the transmission shaft 330, and the transmission shaft 330 has a certain length, the two bearings 500, 600 are respectively arranged at two ends of the transmission shaft 330 to provide a support function and prevent the transmission shaft 330 from being bent. Since one end of the transmission shaft 330 is provided with the second gear 322, and the other end of the transmission shaft 330 is provided with no gear, the first bearing 500 is sheathed on the end of the transmission shaft 330 being provided no gear, that is, is arranged at an inner side of one of the two eccenter assemblies 340; the second bearing 600 is sheathed on the end of the transmission shaft 330 being provided with the second gear 322, that is, is arranged at an inner side of the second gear 322. Two C-shaped fasteners 400 are respectively fixed on two ends of the first bearing 500, and the two C-shaped fasteners 400 provide clamping and limiting effects to the first bearing 500. The second bearing 600 can be fixed by structures that are similar to the structures fixing the first bearing 500.

In this embodiment, the two eccenter assemblies 340 are similar in structure; here, one of the two eccenter assemblies 340 is taken as an example to describe the structure of each eccenter assembly 340. The eccenter assembly 340 includes an eccenter 341 and a bearing assembly 342 arranged at the eccenter 341, an inner side of each of the two massage boards 120 is connected with a tray 700, and the tray 700 is rotatably connected with the bearing assembly 342.

In particular, the bearing assembly 342 includes a third bearing 3421, a fixing block 3422, and a bearing casing 3423 and a lid 3424 which cooperate with each other. The eccenter 341 is provided with an eccentric shaft 3411, the third bearing 3421 is sheathed on the eccentric shaft 3411, the fixing block 3422 is fixed at an outer side of the third bearing 3421 and configured to provide fixing and limiting effects to the third bearing 3421, and the fixing block 3422 is static relative to the eccenter 341. The bearing casing 3423 is axially sheathed on the third bearing 3421, and the lid 3424 covers the bearing casing 3423 along an axial outer side.

More particularly, as shown in FIG. 4, the eccentric shaft 3411 includes a first shaft part 3411*a* and a second shaft part 3411*b*, a diameter of the first shaft part 3411*a* is larger than a diameter of the second shaft part 3411*b*, an end surface of the first shaft part 3411*a* facing the second shaft part 3411*b* is provided with a first fixing hole 3412, and the third bearing 3421 is sheathed on the first shaft part 3411*a*. The bearing casing 3423 has a center hole (not labeled), and the bearing casing 3423 is sheathed on the third bearing 3421 by means of the center hole. The lid 3424 has a center hole (not labeled) too, and an inner diameter of the center hole of the lid 3424 is less than an outer diameter of the third bearing 3421; thus, when the lid 3424 is fixed on the bearing casing 3423 along an outer axial direction, the third bearing 3421 will not fall out through the center hole of the lid 3424. At the same time, the fixing block 3422 is sheathed on the second shaft part 3411*b* and fixed in the first fixing hole 3412 by a first fastening member (not shown), and thus the fixing block 3422 is relatively statically fixed on the second shaft part 3411*b*. The first fastening member can be a screw fastener. In this way, the third bearing 3421 is located in the space enclosed by the lid 3424 and the bearing casing 3423, and is integrated with the lid 3424 and the bearing casing 3423; moreover, since the third bearing 3421 is retained on the eccentric shaft 3411 by the fixing block 3422 and will not fall from the eccentric shaft 3411, the lid 3424 and the bearing casing 3423 will not fall from the eccentric shaft 3411. When the transmission shaft 330 drives the eccenter 341 to rotate, the third bearing 3421 rotates eccentrically along with the eccenter 341; however, the sub-assembly consisting of the bearing casing 3423 and the lid 3424 does not rotate but swing in a small amplitude in response to the eccentric rotation of the third bearing 3421; the swing is transmitted to the trays 700, since the trays 700 are rotatably connected with the bearing assemblies 342, the swing is transformed into small-amplitude swings of the massage boards 120, and is thereby used to massage the eyes of a user. The strength of the swing massage is larger than the strength of airbag massage, but is not as large as the strength of vibration massage, that is, it is between the strengths of the two kinds of existing massage. Such massage can achieve comfort experience and evident effect.

In this embodiment, the bearing casing 3423 is connected with the lid 3424 by a second fastening member (not shown). The second fastening member can be a screw fastener. The bearing casing 3423 and the lid 3424 are provided with connecting holes (not labeled) corresponding to each other, the second fastening member can run through the corresponding connecting holes and thereby fixedly connect the bearing casing 3423 with the lid 3424. Furthermore, the bearing casing 3423 is provided with at least one locating hole 3425, and a side surface of the lid 3424 facing the bearing casing 3423 is provided with at least one locating pole 3426 that is capable of inserting into the locating hole 3425. In this way, by inserting the locating pole 3426 into the locating hole 3425, the lid 3424 can be aligned with the bearing casing 3423 quickly, which is convenient for subsequent screw connections.

In this embodiment, the massage boards 120 are transmittingly connected with the bearing casings 3423 via the trays 700, and finally achieve the connections with the eccenter assemblies 340. In particular, a side surface of each tray 700 that is away from the massage board 120 corresponding to the tray 700 is provided with a connecting shaft 710, the connecting shaft 710 is arranged to be parallel to the tray 700, and the connecting shaft 710 is provided with a hollow first connecting hole 711 extending along an axial direction of the connecting shaft 710; a top of the bearing casing 3423 is provided with two connecting blocks 3427 that are opposite to each other, each connecting block 3427 is provided with a second connecting hole 3428, the connecting shaft 710 is arranged between the two connecting blocks 3427, and the two second connecting holes 3428 correspond to the first connecting hole 711 of the connecting shaft 710; by inserting a third fastening member 800 into the two second connecting holes 3428 and the first connecting hole 711, the bearing casing 3423 can be fixed relative to the tray 700, at the same time, the connecting shaft 710 of the tray 700 can rotate between the two connecting blocks 3427. The third fastening member 800 is preferably a rivet.

The fixing structures between the trays 700 and the massage boards 120 are as follows: a side surface of each tray 700 that is close to the massage board 120 corresponding to the tray 700 is provided with a connecting pole 720; the massage board 120 includes a main body 121 that has a sheet-like shape and is bent, and further includes a plurality of massage contact heads 122 arranged at the main body 121; the main body 121 is provided with a third connecting hole 123, and the connecting pole 720 runs through the third connecting hole 123. In this embodiment, the connecting pole 720 is further provided with a thread hole 721, a screw fastener (not shown) can be, from the side where main body 121 is arranged, screwed into the thread hole 721 to fix the connecting pole 720, and thereby achieve the fixing connection between the tray 700 and the massage board 120.

Preferably, in this embodiment, the plurality of massage contact heads 122 are distributed along an edge of the main body 121, and the massage contact heads 122 correspond to acupoints around eyes. In this way, the massage contact heads 122 can massage the acupoints around eyes targetedly.

What described above are only preferred embodiments of the present invention, and are not intended to limit the scope of the present invention; and any modifications, equivalent replacements, and improvements made within the spirit and principle of the present invention should be included in the protection scope of the present invention.

The invention claimed is:

1. An eye massager, which comprises an eyeshade and a head band connected with the eyeshade; the eyeshade being provided with two massage boards, and the two massage boards being arranged symmetrically and moving synchronously; wherein the eyeshade includes an eyeshade casing, the two massage boards are located on an outer wall of an inner side of the eyeshade casing, and the eyeshade casing is provided therein with a driving assembly configured to drive the two massage boards; the driving assembly includes a motor, a gear assembly driven by the motor, a transmission shaft driven via the gear assembly, and two eccenter assemblies arranged at two ends of the transmission shaft respectively; the two massage boards are respectively fixed on the two eccenter assemblies, and are enabled to swing when being driven by the eccenter assemblies.

2. The eye massager according to claim 1, wherein the gear assembly includes a first gear and a second gear; the first gear is fixed on an output shaft of the motor, the transmission shaft is arranged to be parallel to the motor, the second gear is fixed on an end of the transmission shaft, and the first gear and the second gear mesh with each other.

3. The eye massager according to claim 2, wherein the eye massager further comprises a first bearing and a second bearing; the first bearing is sheathed on an end of the transmission shaft without the second gear, and the second bearing is fixed on the other end of the transmission shaft and located at an inner side of the second gear.

4. The eye massager according to claim 3, wherein each of the eccenter assemblies includes an eccenter and a bearing assembly arranged at the eccenter, a side of each of the two massage boards that faces the eccenter assemblies is connected with a tray, and the tray is rotatably connected with the bearing assembly.

5. The eye massager according to claim 4, wherein the bearing assembly includes a third bearing, a fixing block, and a bearing casing and a lid which cooperate with each other; the eccenter is provided with an eccentric shaft, the third bearing is sheathed on the eccentric shaft, the fixing block is fixed at an outer side of the third bearing and is static relative to the eccenter, the bearing casing is axially sheathed on the third bearing, and the lid covers the bearing casing along an axial outer side.

6. The eye massager according to claim 5, wherein the eccentric shaft includes a first shaft part and a second shaft part, a diameter of the first shaft part is larger than a diameter of the second shaft part, an end surface of the first shaft part facing the second shaft part is provided with a first fixing hole, the third bearing is sheathed on the first shaft part, and the fixing block is sheathed on the second shaft part and fixed in the first fixing hole by a first fastening member.

7. The eye massager according to claim 5, wherein the bearing casing is provided with at least one locating hole, a side surface of the lid facing the bearing casing is provided with at least one locating pole that is capable of extending into the locating hole, and the bearing casing and the lid are connected together by a second fastening member.

8. The eye massager according to claim 5, wherein a side surface of each tray that is away from the massage board is provided with a connecting shaft, and the connecting shaft is provided with a hollow first connecting hole extending along an axial direction of the connecting shaft, a top of the bearing casing is provided with two connecting blocks that are opposite to and spaced from each other, each connecting block is provided with a second connecting hole, and the connecting shaft is rotatably connected between the two connecting blocks.

9. The eye massager according to claim 8, wherein a side surface of each tray that is close to the massage board is provided with a connecting pole; the massage board includes a main body that has a sheet-like shape and is bent, and further includes a plurality of massage contact heads arranged at the main body; the main body is provided with a third connecting hole, and the connecting pole runs through the third connecting hole and is fixed.

10. The eye massager according to claim 9, wherein the plurality of massage contact heads are distributed along an edge of the main body and correspond to acupoints around eyes of persons.

* * * * *